United States Patent [19]

Hiraishi et al.

[11] 4,345,941

[45] Aug. 24, 1982

[54] NON-PICK-UP AND HEAT RESISTANT ALLOY

[75] Inventors: Hisashi Hiraishi; Toshiaki Morichika; Shinichi Murakami, all of Hirakata, Japan

[73] Assignee: Kubota Ltd., Osaka, Japan

[21] Appl. No.: 102,367

[22] Filed: Dec. 11, 1979

[30] Foreign Application Priority Data

Dec. 14, 1978 [JP] Japan ..... 53-155288

[51] Int. Cl.[3] ..... C22C 30/00

[52] U.S. Cl. ..... 75/122; 75/134 F

[58] Field of Search ..... 75/134 F, 122

[56] References Cited

U.S. PATENT DOCUMENTS 3,681,059 8/1972 Shaw et al. ..... 75/134 F

FOREIGN PATENT DOCUMENTS 50-26492 9/1975 Japan .

OTHER PUBLICATIONS

Woldman et al, Engineering Alloys, Fifth Edition, p. 1197.

*Primary Examiner*—R. Dean

*Attorney, Agent, or Firm*—Armstrong, Nikaido, Marmelstein & Kubovcik

[57] ABSTRACT

A heat resistant alloy useful for floor rails, rollers and like structures for use in furnaces and having low amenability to the pick-up of scales formed on the surface of steel materials during heat treatment. The alloy has the composition, in proportions by weight, of 0.1–0.5% C, 1.0–1.8% Si, up to 2.0% Mn, 26–30% Cr, 34–40% Ni, $3 \leqq Co \leqq 9\%$, $37 \leqq Ni+Co \leqq 43\%$, 0.5–3.0% Mo, 0.5 to 5.0% Nb, 0.5–10% W, up to 0.04% P, up to 0.04% S, and balance Fe.

4 Claims, No Drawings

NON-PICK-UP AND HEAT RESISTANT ALLOY

BACKGROUND OF THE INVENTION

1. Field of the Invention

This invention relates to heat resistant alloys useful for structures for use in the interior of heating furnaces, homogenizing furnaces and the like, such as rollers or rails on the floor of the furnace.

2. Description of the Prior Art

High-cobalt alloys containing 20 to 50% by weight of Co are known as heat resistant alloys useful for the structures, such as floor rails and rollers, to be installed in heating furnaces, homogenizing furnaces and like furnaces. These alloys have the advantage that the high Co content enables the structure to retain the desired strength at high temperatures. However, when rails and rollers are used in the furnace at a high temperature of 900° to 1200° C. for supporting thick steel plates and passing them through the furnace for heat treatment, the alloy is liable to react with scales formed on the steel plate, permitting the scales to thermally adhere to the surface of the rail or roller as deposit. This phenomenon, so-called "pick-up", in turn produces a flaw on the surface of the steel plate and impairs the quality of the product. Additionally, such an alloy contains a large quantity of expensive Co and is therefore costly and economically disadvantageous.

SUMMARY OF THE INVENTION

The present invention contemplates provision of low-cobalt alloys which are adapted to contain a reduced amount of Co by incorporating therein Ni, Co and Mo in balanced proportions and yet are comparable to high-cobalt alloys in strength at high temperatures and will not pick up scales formed on the surfaces of steel plates.

The alloys of this invention have the following composition. (Throughout the specification, the percentages are all by weight.)

0.1–0.5% C
1.0–1.8% Si
$0<Mn\leqq 2.0\%$
26–30% Cr
34–40% Ni
$3\leqq Co\leqq 9\%$
0.5–3.0% Mo
0.5–5.0% Nb
0.5–10% W
Up to 0.04% P
Up to 0.04% S
Balance Fe In the above composition, the combined amount of Ni and Co is 37 to 43%.

DETAILED DESCRIPTION OF THE INVENTION

The alloys of this invention contain the above ingredients in quantities in the foregoing ranges and are prepared by melting as is the case with usual alloys.

The individual ingredients and the ranges of the quanitites thereof will be described below.

C: C is contained in austenite, imparting enhanced hardness to the matrix, and combines with Cr, W and Nb, forming compound carbides to give improved hardness at high temperatures and also serve to stabilize the austenite. An excess of C nevertheless results in reduced elongation and impaired weldability, so that the C content should be up to 0.5%. Conversely less than 0.1% of C, if present, fails to afford sufficient strength at high temperatures and renders the austenite instable. Accordingly the proper C content is in the range of 0.1 to 0.5%.

Si: Si serves as a deoxidizer and is effective in giving improved weldability and enhanced resistance to heat. Presence of less than 1.0% of Si leads to insufficient weldability and heat resistance, whereas amounts over 1.8% entail lower toughness and impaired weldability. Thus the desired Si content is 1.0 to 1.8%.

Mn: Mn also serves as a deoxidizer and affords improved weldability. Presence of more than 2.0% of Mn will not lead to any noticeably improved effects. Mn should therefore be contained in an amount of: $0<Mn\leqq 2.0\%$.

Cr: Cr acts to give resistance to oxidation at high temperatures. The alloy must contain at least 26% of Cr so as to retain heat resistance at temperatures as high as 1200° C. Above 30%, reduced toughness and weldability will result. The proper Cr content is in the range of 26 to 30%.

Ni: Ni permits formation of an austenitic matrix and enables the alloy to have improved toughness and retain stabilized strength at high temperatures. When the alloy contains a large amount of Cr as stated above, at least 34% of Ni must be present to stabilize the austenitic phase and prevent pick-up. Even if over 40% of Ni is present, a correspondingly improved effect will not be available. Thus it is suitable that the Ni content be in the range of 34 to 40%.

Co and Ni+Co: Co is essential in giving improved strength at high temperatures and stabilizing the austenitic phase. Less than 3.0% of Co is not fully effective for preventing the pick-up phenomena. Co acts very effectively for the prevention of pick-up when used in balance with Ni. Extensive research has revealed that the desirable range is $37\%\leqq Ni+Co\leqq 43\%$. When used within this range, Co produces outstanding preventive effects, but outside the specified range, reduced effects will result. Amounts above the upper limit are economically disadvantageous. Co provides a stabilized austenite phase and increased strength at high temperatures even if the amount thereof is up to 10%. In view of the range for Ni+Co and the Ni range, Co is used in an amount of up to 9.0%.

Mo: Mo is essential in affording improved compressive strength at high temperatures. To assure satisfactory compressive strength at the high operating temperatures mentioned above, at least 0.5% of Mo should be present, whereas amounts exceeding 3.0% will not produce appreciably enhanced effects but lead to a higher cost, hence uneconomical. Accordingly the proper Mo range is 0.5 to 3.0%.

Nb: Nb gives increased abrasion resistance at high temperatures as well as improved strength at high temperatures and is also effective in preventing pick-up. Amounts less than 0.5% produce lower effects, whereas over 5%, Nb fails to give the desired toughness and weldability. It is therefore suitable to use 0.5 to 5.0% of Nb.

W: W must be present to provide enhanced abrasion resistance and improved strength at high temperatures. Less than 0.5% of W fails to achieve these effects as desired, while amounts over 10% entail a marked reduction in the toughness. The proper range is 0.5 to 10%.

P and S: The amounts of P and S, both of which are impurities, should not exceed 0.04%; otherwise these impurities will adversely affect the strength, toughness, etc. of the alloy.

The balance is Fe. Apparently the alloy contains, in addition to P and S, other elements as impurities, which it is impossible to remove by an industrial process.

Performance Test Example

Low-cobalt alloys of this invention were tested for the degree of pick-up by making the alloys into rails and using the rails within a furnace in an oxidizing atmosphere at 1150° C. for 6 months. The appearance of the rails was thereafter checked with the unaided eye. Similarly tested were a conventional high-cobalt alloy (19.1% Co), and alloys containing Ni and Co in a combined amount outside the range specified in the invention, one exceeding the specified range and the other less than is specified. The compositions of the tested alloys and the results are listed below.

| Alloy | Composition (balance Fe) | | | | | | | | | | | | Pick-up degree |
|---|---|---|---|---|---|---|---|---|---|---|---|---|---|
| | C | Si | Mn | P | S | Cr | Ni | Co | W | Nb | Ni + Co | Mo | |
| Conventional alloy | 0.40 | 1.12 | 1.24 | 0.021 | 0.018 | 26.8 | 20.7 | 19.1 | 3.8 | 3.01 | — | — | C |
| Example of invention | 0.35 | 1.21 | 1.30 | 0.018 | 0.021 | 26.1 | 34 | 7.9 | 0.9 | 4.8 | 41.9 | 0.6 | A |
| | 0.38 | 1.20 | 1.15 | 0.020 | 0.019 | 27.0 | 37 | 5.0 | 5.3 | 3.0 | 42.0 | 0.7 | A |
| | 0.33 | 1.19 | 1.20 | 0.019 | 0.020 | 29.0 | 39 | 3.1 | 9.5 | 0.6 | 42.1 | 0.6 | A |
| | 0.39 | 1.20 | 1.18 | 0.019 | 0.021 | 28.5 | 35 | 3.1 | 4.1 | 3.8 | 38.1 | 0.8 | A |
| Ni + Co content | | | | | | | | | | | | | |
| Too low | 0.35 | 1.19 | 1.20 | 0.018 | 0.019 | 27.9 | 30 | 2.5 | 8.1 | 0.7 | 32.5 | 0.6 | D |
| Too high | 0.38 | 1.20 | 1.18 | 0.021 | 0.020 | 28.1 | 39.5 | 5.0 | 5.5 | 2.9 | 44.5 | 0.7 | B |

Note:
Pick-up degree
A . . . No pick-up.
B . . . Slight pick-up.
C . . . Moderate pick-up (removable when rubbed by hand).
D . . . Marked pick-up.

The test results reveal that the low-cobalt alloys of this invention having the specified composition possess greatly improved non-pick-up properties and are therefore usable without entailing degradation of thick steel plates. Although the present alloys are adapted to contain the expensive Co component in a reduced amount of 3.0 to 9% by virtue of the combination of Ni and Mo, the alloys are comparable to high-cobalt alloys in strength at high temperatures for use as furnace rails and are accordingly economically usable. The above table indicates that the alloys containing Ni and Co in a combined amount above or below the range specified by the invention involve a higher degree of scale pick-up than the alloys of the invention.

What is claimed is:

1. A non-pick-up and heat resistant alloy consisting essentially of, by weight:

0.1–0.5% C,
1.0–1.8% Si,
$0<Mn\leqq 2.0\%$,
26–30% Cr,
34–40% Ni,
$3\leqq Co\leqq 9\%$,
0.5–3.0% Mo,
0.5–5.0% Nb,
0.5–10% W, and
balance Fe;

wherein the total amount of Ni and Co is 37–43%.

2. The alloy of claim 1 wherein P and S are present as impurities in an amount of up to 0.04% by weight.

3. A rail suitable for use in furnaces, said rail being a non-pick-up and heat resistant alloy consisting essentially of, by weight:

0.1–0.5% C,
1.0–1.8% Si,
$0<Mn\leqq 2.0\%$,
26–30%Cr,
34–40% Ni,
$3\leqq Co\leqq 9\%$,
0.5–3.0% Mo,
0.5–5.0% Nb,
0.5–10% W, and
balance Fe;

wherein the total amount of Ni and Co is 37–43%.

4. A roller suitable for use in furnaces, said roller being a non-pick-up and heat resistant alloy consisting essentially of, by weight:

0.1–0.5% C,
1.0–1.8% Si,
$0<Mn\leqq 2.0\%$,
26–30% Cr,
34–40% Ni,
$3\leqq Co\leqq 9\%$,
0.5–3.0% Mo,
0.5–5.0% Nb,
0.5–10% W, and
balance Fe;

wherein the total amount of Ni and Co is 37–43%.

* * * * *